US012527387B2

(12) United States Patent
Onyon

(10) Patent No.: US 12,527,387 B2
(45) Date of Patent: Jan. 20, 2026

(54) APPARATUS, METHOD, AND SYSTEM FOR CLEANING A SHAVING DEVICE

(71) Applicant: Antonio J. Onyon, Delray Beach, FL (US)

(72) Inventor: Antonio J. Onyon, Delray Beach, FL (US)

( * ) Notice: Subject to any disclaimer, the term of this patent is extended or adjusted under 35 U.S.C. 154(b) by 533 days.

(21) Appl. No.: 17/887,570

(22) Filed: Aug. 15, 2022

(65) Prior Publication Data

US 2024/0049861 A1 Feb. 15, 2024

(51) Int. Cl.
*A45D 27/46* (2006.01)

(52) U.S. Cl.
CPC ..... *A45D 27/46* (2013.01)

(58) Field of Classification Search
CPC ..... A45D 27/46
See application file for complete search history.

(56) References Cited

U.S. PATENT DOCUMENTS

| | | | |
|---|---|---|---|
| 6,102,055 | A | 8/2000 | Karnatz |
| 2006/0048794 | A1 | 3/2006 | Kappes et al. |
| 2006/0283487 | A1 | 12/2006 | Grabowski |
| 2008/0060671 | A1 | 3/2008 | Ruffin |
| 2011/0225834 | A1 | 9/2011 | Cirilli |
| 2014/0083052 | A1 | 3/2014 | Cosper |
| 2019/0001375 | A1 | 1/2019 | Nascimento |

FOREIGN PATENT DOCUMENTS

| | | | | |
|---|---|---|---|---|
| KR | 20220047135 A | | 4/2022 | |
| WO | WO2020018817 | * | 1/2020 | ..... A46B 5/00 |

OTHER PUBLICATIONS

Mystique Life, "Razorbooster: Effortless Way to Clean Your Razor", May 11, 2021, Republic of Korea, (accessible at: https://www.indiegogo.com/projects/razorbooster-effortless-way-to-clean-your-razor#/).

* cited by examiner

*Primary Examiner* — Jason Y Ko
(74) *Attorney, Agent, or Firm* — Derek Fahey, Esq.; The Plus IP Firm, PLLC

(57) ABSTRACT

In one embodiment, an apparatus, system, and method for cleaning shaving devices is disclosed. The apparatus comprises a base, an attaching element, a trough, and a plurality of removable bristles attached to an inside bottom wall of the trough such that substantially all of the bristles extend upward toward the trough opening. A fluid is disposed within the trough submerging substantially all of the removable bristles. The apparatus further includes a removable lid having an elongated opening and a holding element configured for retaining a shaving device. The base includes a mating surface on the top side of the base, while the trough includes a mating surface located on the outside of the trough. These mating surfaces are in the form of a track allowing the user to easily remove the trough to empty and refill the liquid when needed.

11 Claims, 13 Drawing Sheets

APPARATUS, METHOD, AND SYSTEM FOR CLEANING A SHAVING DEVICE

CROSS-REFERENCE TO RELATED APPLICATIONS

Not applicable.

STATEMENT REGARDING FEDERALLY SPONSORED RESEARCH OR DEVELOPMENT

Not applicable.

INCORPORATION BY REFERENCE OF MATERIAL SUBMITTED ON A COMPACT DISC

Not applicable.

TECHNICAL FIELD

The present disclosure relates to the field of devices for personal hygiene maintenance, and more specifically to the field of devices for cleaning and maintaining shaving devices.

BACKGROUND

Here are the problems with the existing technology. The industry of personal hygiene products relies on the consumer to regularly use and purchase these grooming products in order to ensure a constant flow of profit. If used regularly, many of these products will need to be purchased periodically as the quality of these products decreases. For example, hand held razors used for shaving experience constant force against the blades periodically which can result in a dull blade, insufficient results, and buildup between blades. These factors often cause consumers to throw away the bladed attachment and replace with a new one or, depending on the type and price of the razor, throw away and replace the entire handheld razor.

The most affordable and common device for personal hair care is a razor. The problem with these common razors is that they lack a method to maintain the quality and cleanliness of the blades. Many people tend to place their razors on a ledge in their bathroom without cleaning said razor, allowing the hair, soap, and filth sit in the razor until its next use. Other people attempt to clean their razor by placing it under running water and/or using their hands to wipe away the buildup between the blades. This way of cleaning the razor can be time consuming, tedious, wasteful of water, and dangerous to the user if not done carefully.

Additionally, by failing to clean the blade of a razor, the razor can rust and/or dullen which may decrease the lifetime use of the razor. This will cause the user to spend more money replacing the razor blades more frequently. Considering the current shaving devices on the market have numerous blades, the cost to replace the razor blades can quickly add up.

Moreover, the gap between blades of a typic razor ranges from 0.010 in. to 0.038 inches which makes it difficult to properly clean the razor blade. This is an extremely small amount of space that needs to be clear of any debris before use. By using an old, dirty razor blade on your skin, the risk of infection increases, and even greater chance when shaving over irritated skin. Bacteria formed on the unclean razor blade can bypass your outermost layer of skin through microscopic tears which may cause numerous health complications.

As a result, there exists a need for improvements over the prior art and more particularly for a more efficient way of cleaning a shaving device.

SUMMARY

A system and method for cleaning shaving devices is disclosed. This Summary is provided to introduce a selection of disclosed concepts in a simplified form that are further described below in the Detailed Description including the drawings provided. This Summary is not intended to identify key features or essential features of the claimed subject matter. Nor is this Summary intended to be used to limit the claimed subject matter's scope.

In one embodiment, an apparatus, system, and method for cleaning shaving devices is disclosed. The apparatus comprises a base, an attaching element, a trough, and a plurality of removable bristles attached to an inside bottom wall of the trough such that substantially all of the bristles extend upward toward the trough opening. A fluid is disposed within the trough submerging substantially all of the removable bristles. The apparatus further includes a removable lid having an elongated opening and a holding element configured for retaining a shaving device. The base includes a mating surface on the top side of the base, while the trough includes a mating surface located on the outside of the trough. These mating surfaces, in one embodiment, define a track allowing the user to easily remove the trough to empty and refill the liquid when needed.

Additional aspects of the disclosed embodiment will be set forth in part in the description which follows, and in part will be obvious from the description, or may be learned by practice of the disclosed embodiments. The aspects of the disclosed embodiments will be realized and attained by means of the elements and combinations particularly pointed out in the appended claims. It is to be understood that both the foregoing general description and the following detailed description are exemplary and explanatory only and are not restrictive of the disclosed embodiments, as claimed.

BRIEF DESCRIPTION OF THE DRAWINGS

The accompanying drawings, which are incorporated in and constitute part of this specification, illustrate embodiments of the disclosure and together with the description, explain the principles of the disclosed embodiments. The embodiments illustrated herein are presently preferred, it being understood, however, that the disclosure is not limited to the precise arrangements and instrumentalities shown, wherein.

DETAILED DESCRIPTION

Figure 1A:
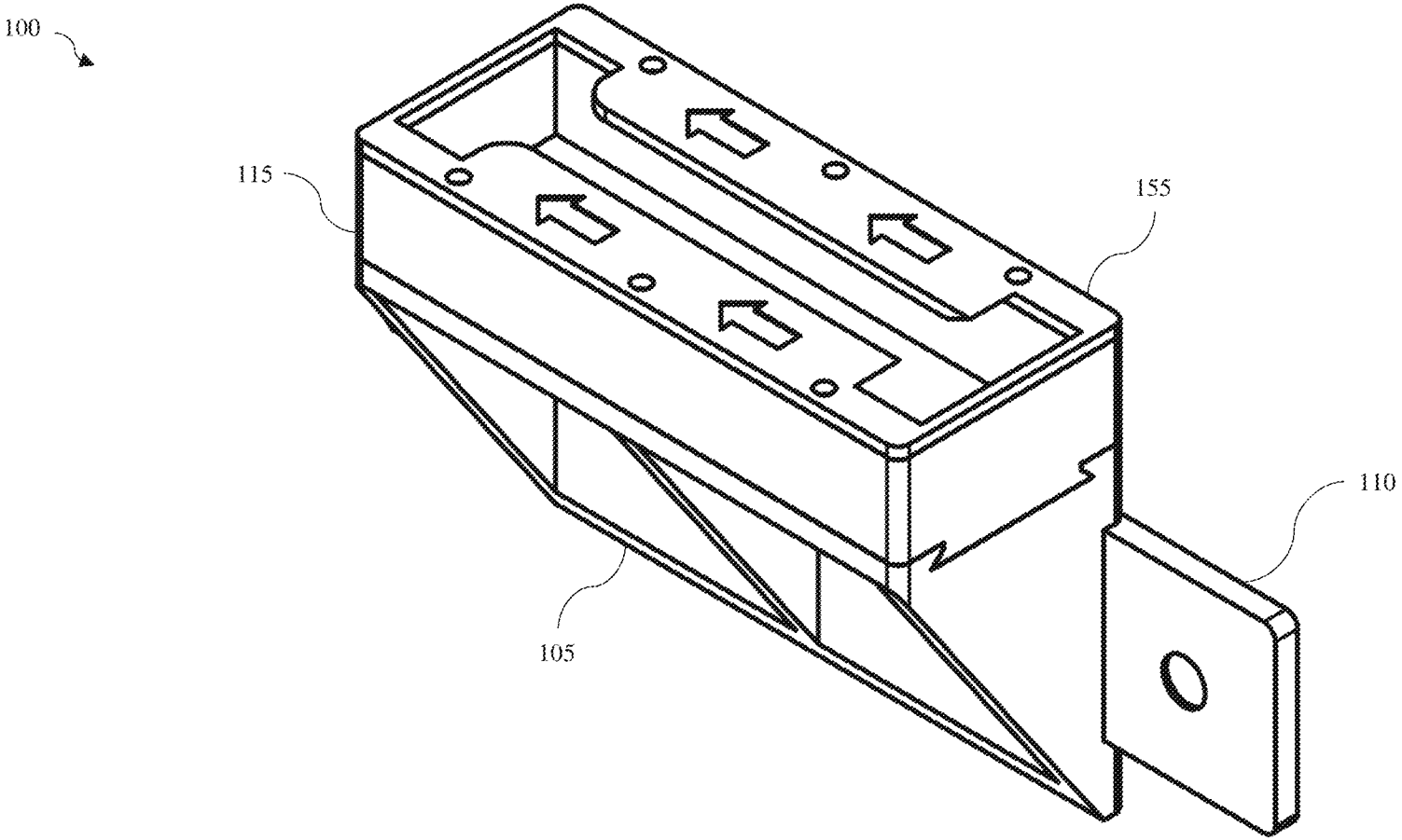
FIG. 1A is a front perspective view of an apparatus for cleaning shaving devices, according to an example embodiment.
Figure 1B:
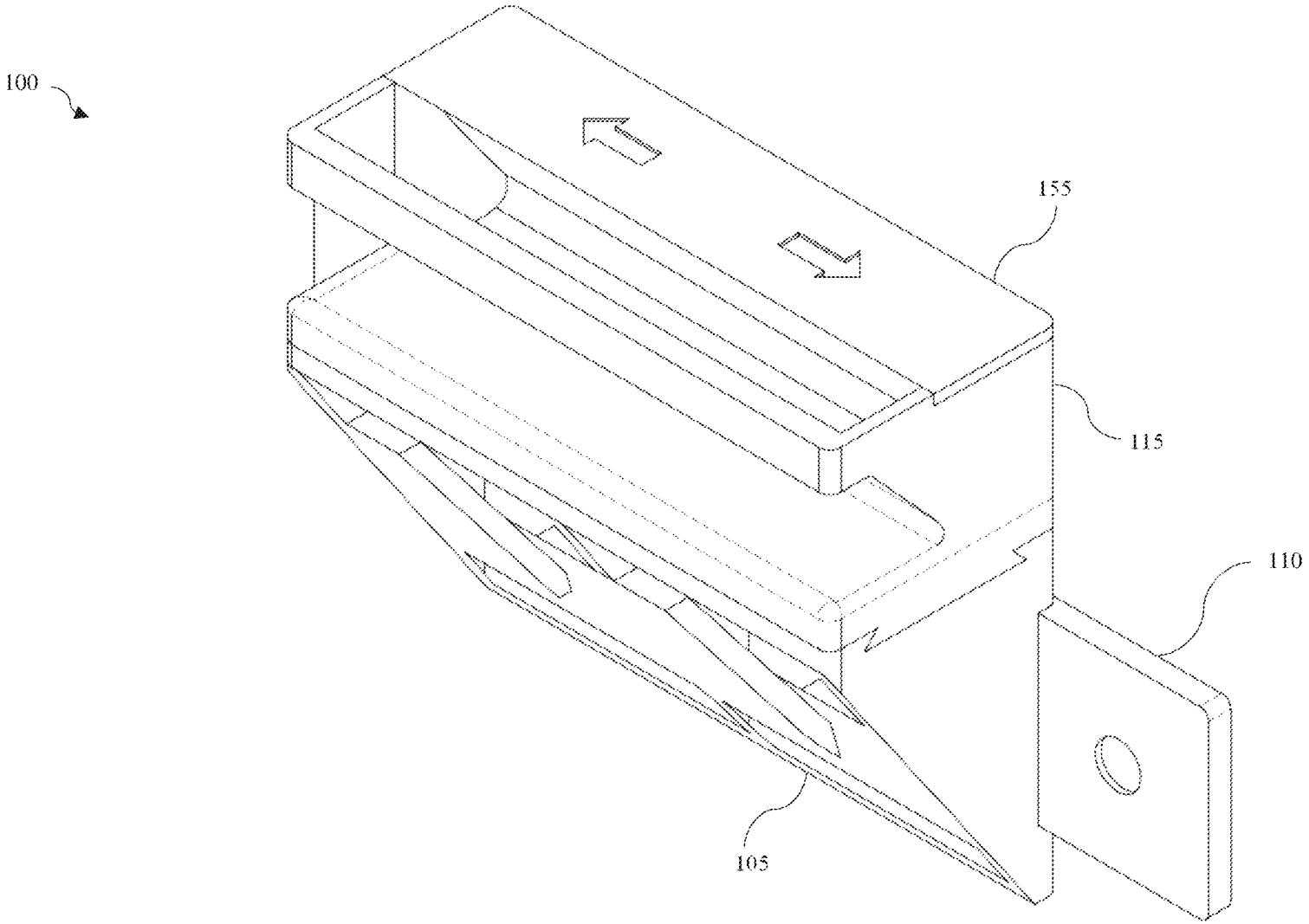
FIG. 1B is a front perspective view of an apparatus for cleaning shaving devices, according to a second example embodiment.

The following detailed description refers to the accompanying drawings. Whenever possible, the same reference numbers are used in the drawings and the following description to refer to the same or similar elements. While disclosed embodiments may be described, modifications, adaptations, and other implementations are possible. For example, substitutions, additions, or modifications may be made to the elements illustrated in the drawings, and the methods described herein may be modified by substituting reordering or adding additional stages or components to the disclosed methods and devices. Accordingly, the following detailed description does not limit the disclosed embodiments. Instead, the proper scope of the disclosed embodiments is defined by the appended claims.

The disclosed embodiments improve upon the problems with the prior art by providing an apparatus, method, and system for cleaning shaving devices. For example, the disclosed embodiments provide a user with a shaving device holder. After the user cleans the device and is ready to store it for next use, they can simply hang the head of the shaving device on the groves configured for retaining the device allowing for easy retrieval. This holder also allows the razor to dry having the water drain down out of the holder preventing bacteria or rust from forming on the blades from stagnate water. The disclosed embodiments also solve the issue with cleaning the razor blades on the device itself. The following embodiments present a device with elements such as a trough and bristles strategically placed in order to clear each blade and each gap between blades of any excess hair or any debris. This method of cleaning a shaving device prevents the user from harming themselves from using his or her skin when cleaning razor blades and ensures a longer shaving device life by maintaining the quality of the device.

Referring now to the Figures, FIGS. 1A through 4B illustrate an apparatus 100 for cleaning shaving devices, according to an example embodiment. The apparatus includes a base 105, an attaching element 110, a trough 115, and a removable lid 155. The base includes a mating surface located on the top side of the base where the mating surface is defined as a track configured to removably attach to the second mating surface on the trough. The trough is an open container configured to house cleaning fluid and is a long, narrow container such that it is configured to receive a shaving device, such as a head of a razor. The attaching element is a portion of the base and/or an element in attachment with the base that is configured to secure and/or provide a means of securing the base to an independent object. The removable lid is an element configured to cover the open portion of the trough to provide a closed and/or substantially closed container. The base is the structure for which the trough removably attaches to.

The base may be made out of metallic material such as carbon steel, stainless steel, aluminum, Titanium, other metals or alloys, composites, ceramics, polymeric materials such as polycarbonates, such as Acrylonitrile butadiene styrene (ABS plastic), Lexan™, and Makrolon™. Other materials having waterproof type properties may also be incorporated. The base may be made of other materials and is within the spirit and the disclosure.

The base may be formed from a single piece or from several individual pieces joined or coupled together. The components of the base may be manufactured from a variety of different processes including an extrusion process, a mold, casting, welding, shearing, punching, folding, 3D printing, CNC machining, etc. However, other types of processes may also be used and are within the spirit and scope of the present invention.

It is understood that the attaching element, the trough, and/or the removable lid may each be formed by the same processes and/or materials as the base. It is understood that the combination of these elements to define the apparatus 100 may comprises a plurality of different compositions and materials consistent with this disclosure. The elements of apparatus 100 may comprise other materials and/or be formed by other processes that are within the spirit and scope of the disclosure.

Figure 2A:
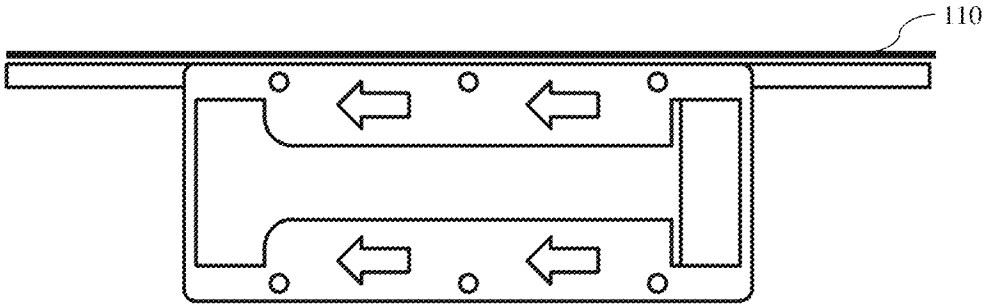
FIG. 2A is a top view thereof, according to an example embodiment.
Figure 2B:
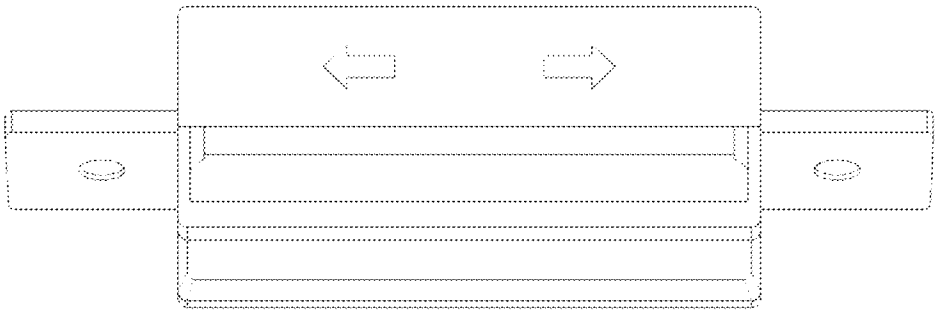
FIG. 2B is a top view thereof, according to a second example embodiment.
Figure 6A:
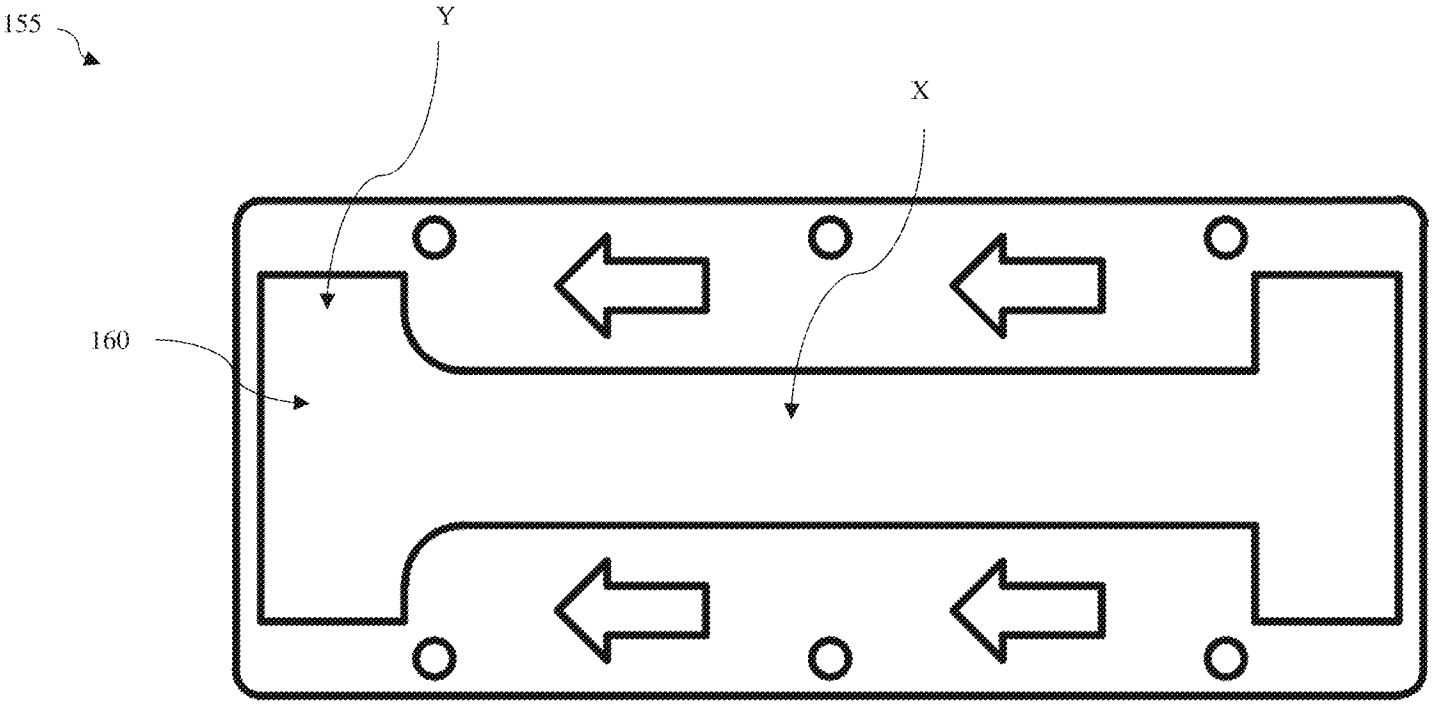
FIG. 6A is a top view of a removable lid, according to an example embodiment.

FIG. 2A is an example embodiment of a top view of the apparatus illustrating the removable lid, and the attaching element. FIG. 2B is a second example embodiment of a top view of the apparatus having a removable lid. The removable lid is located on top of the trough and includes an elongated opening for the user to insert his or her shaving device. The removable lid may also include writing or drawings such as arrows guiding or instructing the user to use the apparatus in a certain manner for efficiency. The arrows can indicate the direction to slide the removable lid off the trough, or they might indicate the direction the user is to move the razor inside the trough. The removable lid also acts as a protective cover protecting the bristles from any exterior objects, as well as simply covering the trough so that the user does not see the liquid with the buildup that is being removed from the razor. The shape of the elongated opening takes shape of the letter "I" having an entry and an exit sized to match a bladed section of a shaving device. As shown in FIG. 6A, section Y of the elongated opening is wide allowing for the head of a razor to easily enter the trough while section X of the elongated opening remains narrow allowing only the razor handle to fit through the opening. The narrow section of the channel may retain the head of the razor within the trough while also keeping the cleaning fluid within the trough. In other embodiments, this opening may allow air to escape the system to prevent a buildup of bacteria. In other embodiments, the opening may be covered by a transparent film or window to be able to see into the trough, for example, to see the fluid levels within the trough.

Figure 3A:
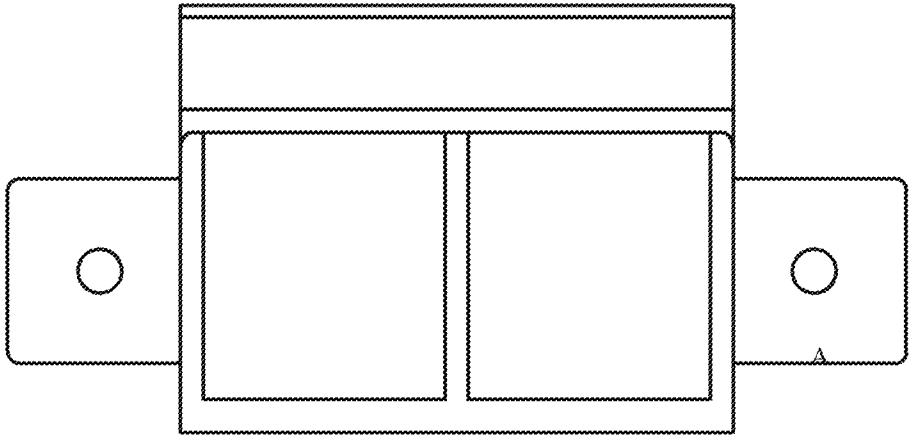
FIG. 3A is a front view thereof, according to an example embodiment.
Figure 3B:
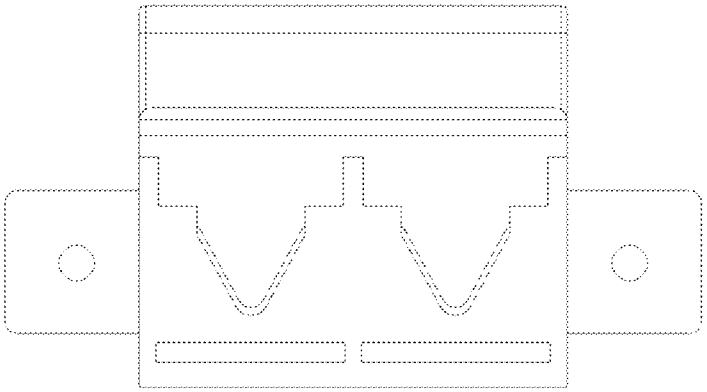
FIG. 3B is a front view thereof, according to a second example embodiment.

Referring to FIG. 3A, the front view of the base is rectangular having two sections divided by what may be a structural component used to provide support to the top side of the base, according to an example embodiment. FIG. 3B is a second example embodiment of the base having a different front facing surface with four openings to allow for water flow rather than buildup. Another possible reason for the openings is to save money when manufacturing by using less material.

Figure 4B:
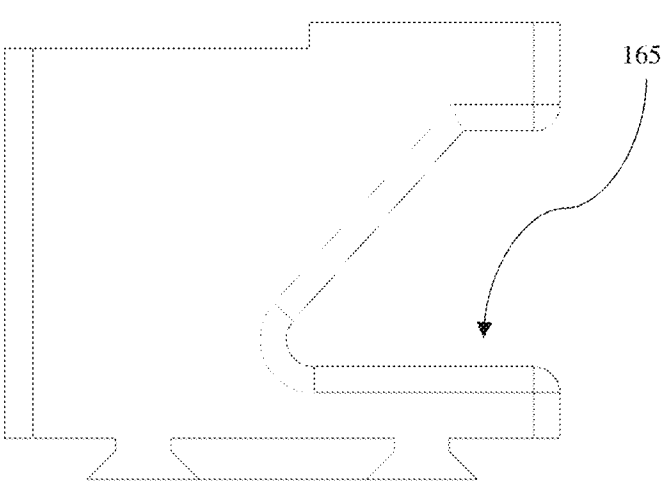
FIG. 4B is a side view thereof, according to a second example embodiment.
Figure 4A:
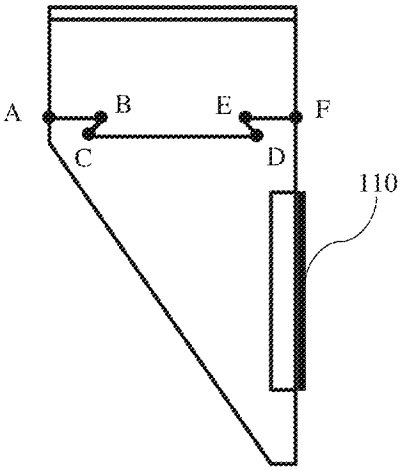
FIG. 4A is a side view thereof, according to an example embodiment.

The side view of the base, shown if FIG. 4A, is triangular in shape, with the track located on the top of the base. The side view of the base, as seen in FIG. 4A, shows an outline of the track forming the top surface of the base beginning at point A and ending at point F. Starting at point A, the outline extends horizontally forming a straight line, and stopping at point B. Then, the outline continues downward stopping at point C creating the angle ABC. Angle ABC is roughly 45 degrees. From point C, the outline extends to the right forming a straight line until it reaches point D. Then at point D, the outline continues upward forming line DE by stopping at point E. Angle CDE is roughly 45 degrees. From point E the outline extends to the right until reaching point F. As mentioned before this outline of the track forms the top surface of the base which will fit to the second mating surface located on an outside surface of the trough.

In this embodiment, the track or mating surface is a dovetail joint removably interlocking the base to the trough. Dovetail joints are known for their durability and strength due to the way their pins and tails are oriented. The use of this joint allows the user to slide the trough along the track when removing and attaching to and from the base. This joint benefits this device by ensuring a strong connection between the two components which is important to keep the trough stable as the user move the razor side to side. In the example embodiment shown, because the dovetail joint does not extend through the entire length of the trough, the trough is limited to only sliding off of the base in one direction and therefore cannot be removed from either side of the base. Additionally, the dovetail track or joint prevents the trough from being pulled off of the base upwards and prevents the trough from disengaging the base when the razor is being cleaned.

FIG. 4B illustrates a second example embodiment of the trough. This trough has side profile displaying the holding element 165 in the form of a shelf. In other embodiments, the trough may comprise a portion having the opening to retain the cleaning fluid and receive the razor. In FIG. 4B, the trough may include a cutout portion on at least one of the side walls of the trough. As shown, the front side of the trough has a recessed portion to define a ledge or shelf proximate to the bottom side of the trough. This shelf may be sized to hold the razor blade and/or replacement razor blades, for example, for compact storage. As shown, this embodiment still has the mating surface on the bottom of the trough to removable attach to the base. The trough being removably attached allows the trough to be filled with water and/or cleaned. In other embodiments, the trough may be affixed to the base; however, the user would need to be able to removably attach the base to and from the independent surface for filling and/or cleaning.

Figure 5A:
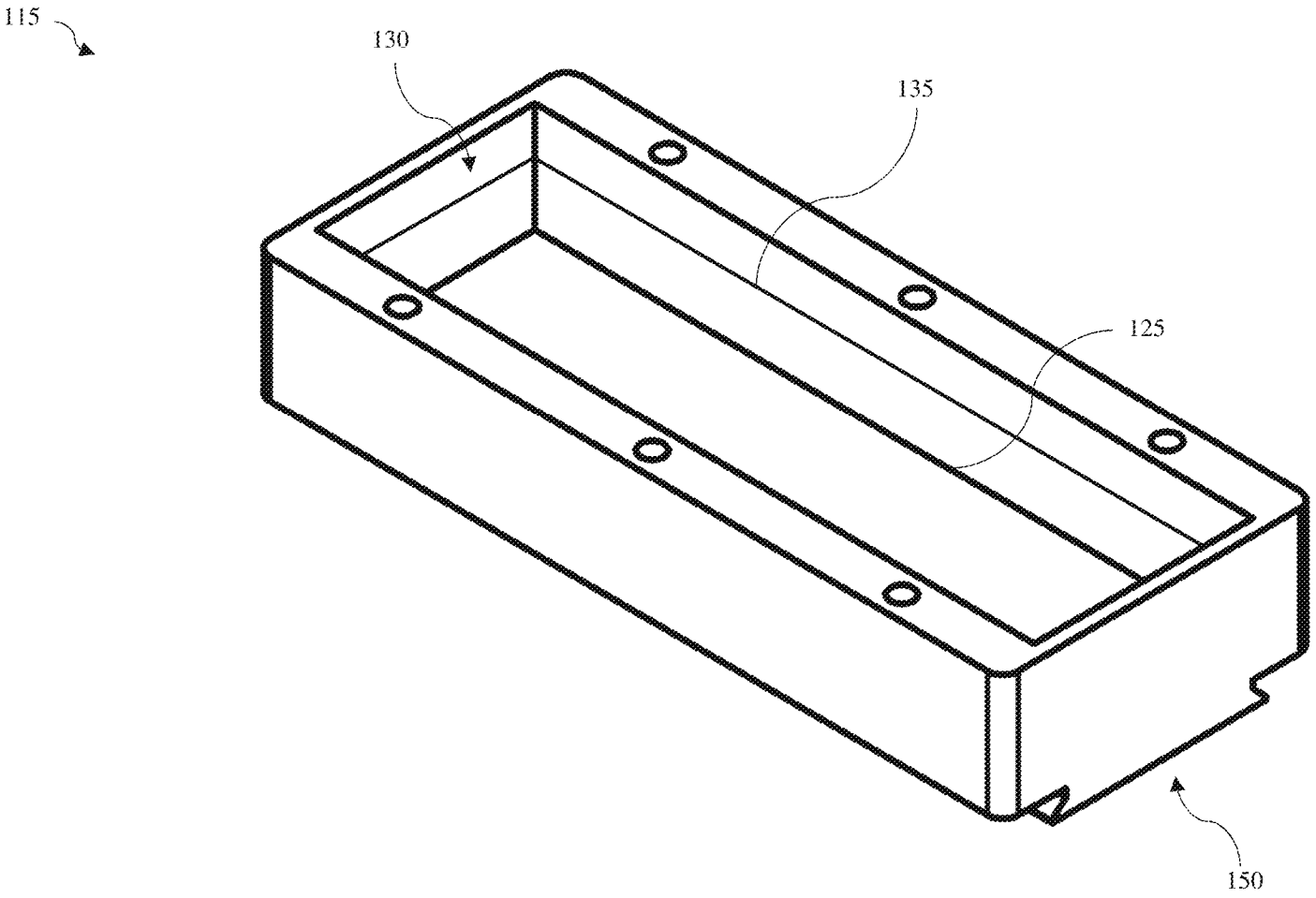
FIG. 5A is a front perspective view of a trough, according to an example embodiment.
Figure 5B:
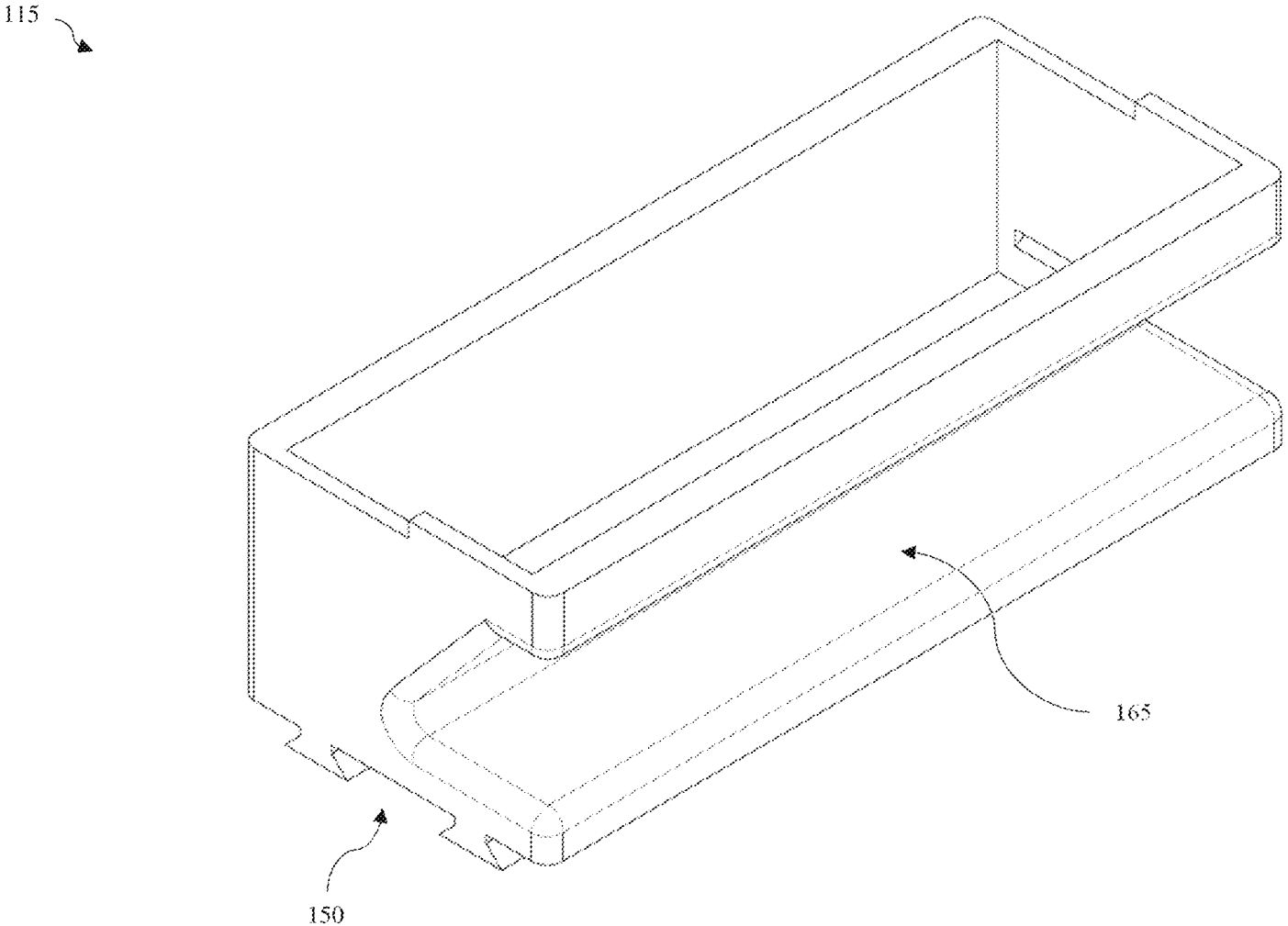
FIG. 5B is a front perspective view of a trough, according to a second example embodiment.

FIGS. 5A and 5B illustrate two example embodiments of a trough 115 having a trough opening 130, fluid disposed within the trough and having a fluid top surface 135. The fluid top surface being above at least substantially all the plurality of the removable bristles. The removable bristles being attached to an inside bottom wall 125 of the trough. The trough also includes a second mating surface 150 on an outside surface of the trough.

The second mating surface located on the bottom outside surface of the trough is configured to removably attach to the base mating surface. The plurality of removable bristles are attached to a removable pad that rests on the inside bottom wall of the trough. The pad is attached to the inside bottom wall of the trough such that substantially all of the removable bristles extend vertically toward the trough opening. The liquid stored inside the trough may be water, an antibacterial soap, other cleaning fluids and/or a combination thereof.

FIG. 5B includes a holding element 165 for retaining a shaving device. In one embodiment, the holding element may be in the form of a hook and/or ring allowing the razor portion to be hung alongside the apparatus. In another embodiment, the holding element may be in the form of a shelf sized to fit the shaving device. The holding element may be attached to the apparatus by adhesive, a hook and loop element, magnets, fasteners etc. The holding element may be a kind of receptacle that forms to the handle of the shaving device. The holding element may be attached to the base or trough of the apparatus, the trough of the apparatus, or the removable lid attached to the trough. The holding element may be comprised of the same materials as the base.

Figure 6B:
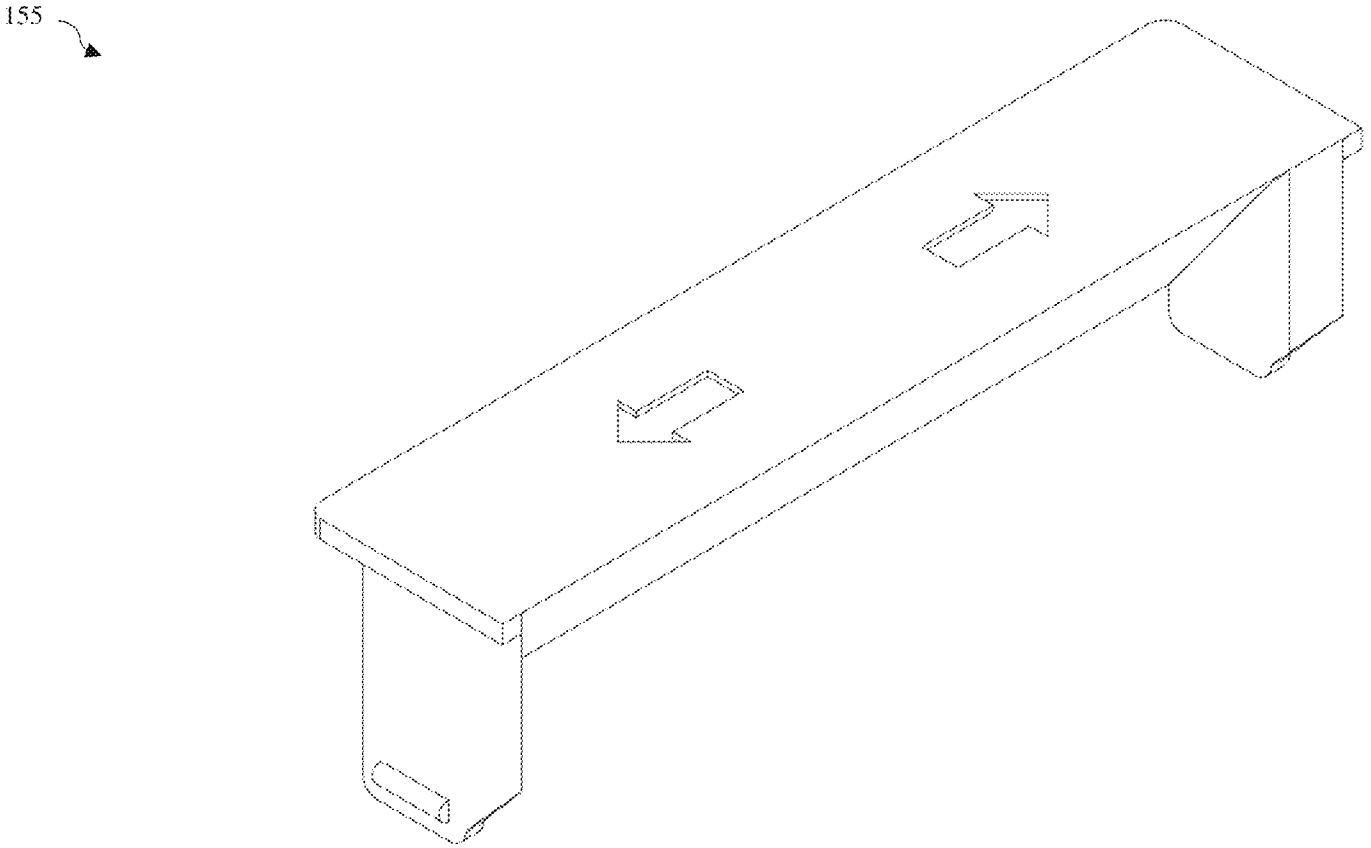
FIG. 6B is a front perspective view of a removable lid, according to a second example embodiment.

FIGS. 6A and 6B illustrate two example embodiments of a removable lid 155 having an elongated opening 160. The removable lid may have images or words displayed on the top surface directing the user how to use the device properly. The removable lid may also have a form of adhesive applied to the bottom surface of the lid allowing it to stick to the trough properly. In other embodiments, there may be magnets attached to the lid and trough allowing for easy attachment and detachment. Example of possible magnets include a permanent magnet such as neodymium iron boron (NdFeB), samarium cobalt (SmCo), alnico, ceramic, ferrite magnets, etc. However, other types of magnets may also be used and are within the spirit and scope of the present invention. In other example embodiments, there may be holes lining the perimeter of the removable lid oriented to receive a rod connecting the lid to the trough. The removable lid may also include a hinge or snap for connecting the lid to the trough. Types of hinging elements may include barrel hinges, piano hinges, butterfly hinges, pivot hinges, living hinges, spring hinges, butt hinges, pivot hinges, etc. The removable lid may be comprised of the same materials as the base.

Figure 7A:
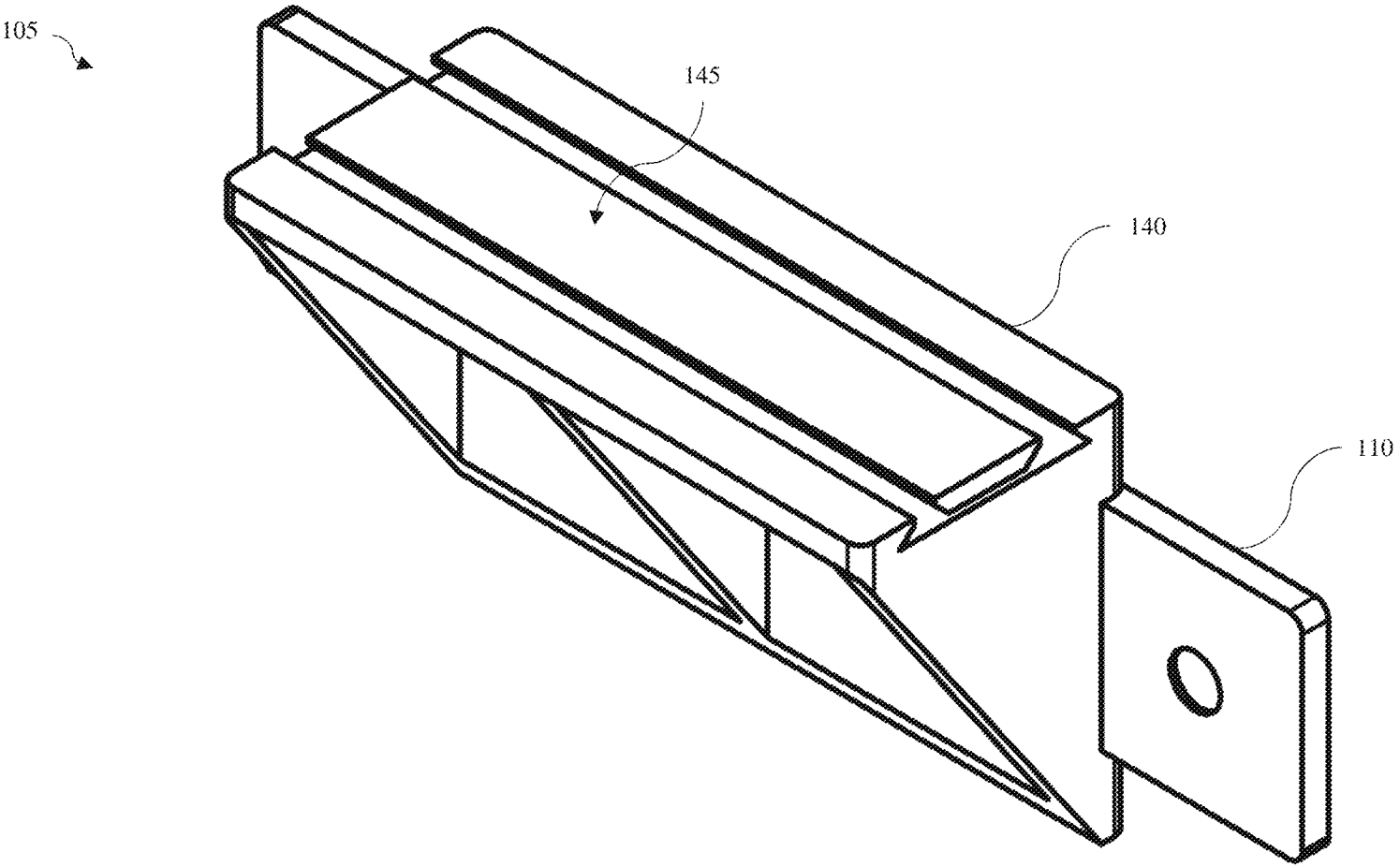
FIG. 7A is a front perspective view of a base, according to an example embodiment.
Figure 7B:
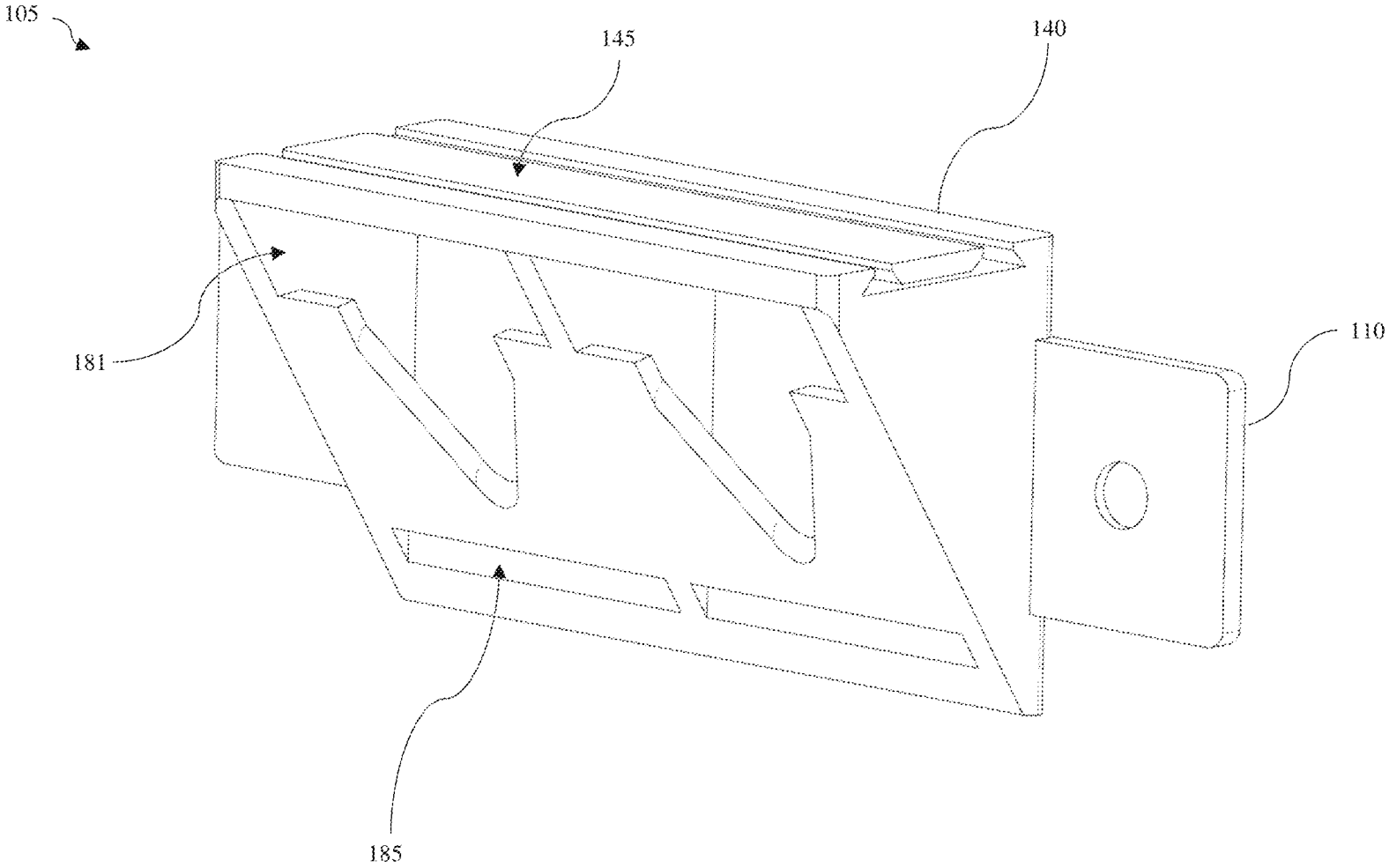
FIG. 7B is a front perspective view of a base, according to a second example embodiment.

FIGS. 7A and 7B illustrate a base 105 having a mating surface 140 located on a top side 145 of the base, and an attaching element 110, according to the example embodiment. The mating surface is located on the top of the base allowing for the trough to attach in such a way that the fluid is concealed inside the trough with no spilling from any side. As mentioned above, from the front, the base is rectangular having two sections divided by a structural component used to provide support to the top side of the base. From the side the shape of the base is triangular, according to the example embodiment. In other embodiments the base may have curved edges, may appear rectangular from all views, the base may appear as an entirely different shape, the base may be cup-like having a circular cross section, etc.

The attaching element is used for securing the apparatus to an object or surface allowing the user to choose where to place the apparatus based on the user's preference. In the example embodiment, the attaching element acts as a receiving end of a fastener, as shown, the receiving section is a hole or opening which will receive the shaft of a screw or nail to secure the base to a surface, such as a wall, for example. However, in other embodiments the attaching element may be in the form of a suction cup, a magnet, hook and loop fasteners, snap fasteners, adhesive, etc. The attaching element may be made from a variety of different materials, and manufactured by a variety of different manufacturing processes.

As mentioned above, FIG. 7B illustrates a second example embodiment having several openings on the front side of the base. These openings may be used to prevent water buildup in the device allowing water to continuously flow through the apparatus. These openings may also be important to the manufacturer to lessen the amount of material used when producing the apparatus. Similarly to FIG. 7A, the center of the base is supported by a piece of material extending from the back side of the base to the front side of the base.

The front view of the base has a cutout sized to a razor head with a narrowing and/or tapered section. Because the wall of the base is slanted, the head of the razor will fall into the pocket of the base and be held by the base. In this example embodiment the base acts as a holding element. This holding element is efficient for retaining a shaving device because the size of the opening 181 is configured to allow easy insertion of a razor head while the narrowing or tapered section allows the handle of the shaving device to sit at the bottom of the V-shaped opening. This V-shaped opening also allows for a plurality of razor handles to fit comfortably in the pocket making the holding element more versatile to differently sized and shaped shaving devices. The way this holding element is configured, it encloses the razor blades within the base shielding the blades from excess water, debris, etc. while also preventing the user from accidentally grabbing the head of the razor rather than the handle.

The base also has at least one drain slot 185 to allow water to excrete from the base. This will allow air to circulate and prevent mold, mildew, and bacteria from accumulating between the blades. These drain slots are important to prevent unnecessary and unneeded water or cleaning fluid buildup in the base which would require a user to detach the base from the wall or surface and empty the base in addition to emptying the trough. In other embodiments the drain slots may be sized or shaped differently. For example, in other embodiments the drain slots may include small circular holes or in other embodiments the front wall of the base can be made from a mesh-like material allowing fluid to exit the base.9

In other embodiments the track can include a differently shaped mating surface or simply a different design of track still allowing for removably attaching two parts or components. In other embodiments the track may be configured to encompass one of a plurality of different mating surfaces within the spirit and scope of the invention. For example, the track may be configured to secure the trough to the base via a sliding mechanism, an interlocking mechanism, a press-fit mechanism, a force-fit, snap-fit, etc.

Figure 8:
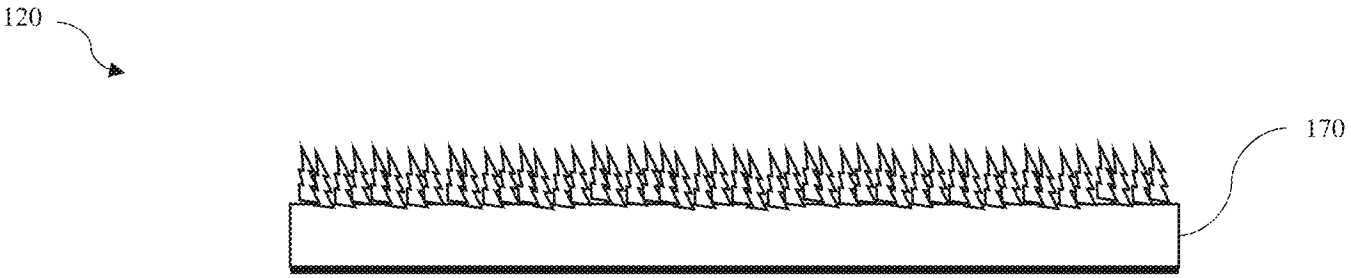
FIG. 8 is a front perspective view of a plurality of removable bristles, according to an example embodiment.

FIG. 8 illustrates a plurality of removable bristles 120 attached to a removable pad 170 that rests on the inside bottom wall of the trough such that substantially all of the removable bristles extend toward a trough opening, according to the example embodiment. The removable bristles are relative to the fluid by the fluid top surface being above at least substantially all the plurality of the removable bristles. The bristles are arranged vertically pointing upwards towards the opening of the trough.

When constructing a brush-like cleaning device, the first component manufactured is the handle or the material used to hold the bristles. In the example embodiment this component is the removable pad. This component must be made from solid sturdy materials in order to hold the bristles in place and able to be used continuously. Once the block, or removable pad is created, then the bristles may be installed. Bristles are available in many varieties as there are many different types and forms of brushes. Common bristles can be made from vinyl, nylon, animal hair such as or horse or boar hair, plant-based materials, synthetics, polypropylene, and/or metal wire. The removable bristles illustrated in the example embodiment need to be strong and durable enough to withstand sharp and thin razor blades and constant impact and friction that will be endured during the cleaning of the razor blades. Regarding the bristle pad, the bristles are usually inserted by a machine in tight bundles. The insertion process is performed by folding and stapling the bundles into predrilled holes, or they can be folded over a small piece of metal, wood, or fabric as to create a pad, of which the pad comprises a material form fit to the bottom interior wall of the trough and having the plurality of bristles attached thereto.

The pad will attach to the inside bottom surface of the trough where it may be held on by magnetic force, by adhesive, by use of hook and loop elements, clips, etc. The removable pad may have a coating on the bottom surface allowing it to stick to the bottom of the trough, of which may also include a material to preserve the adhesive, such as wax paper for example.

Figure 9:
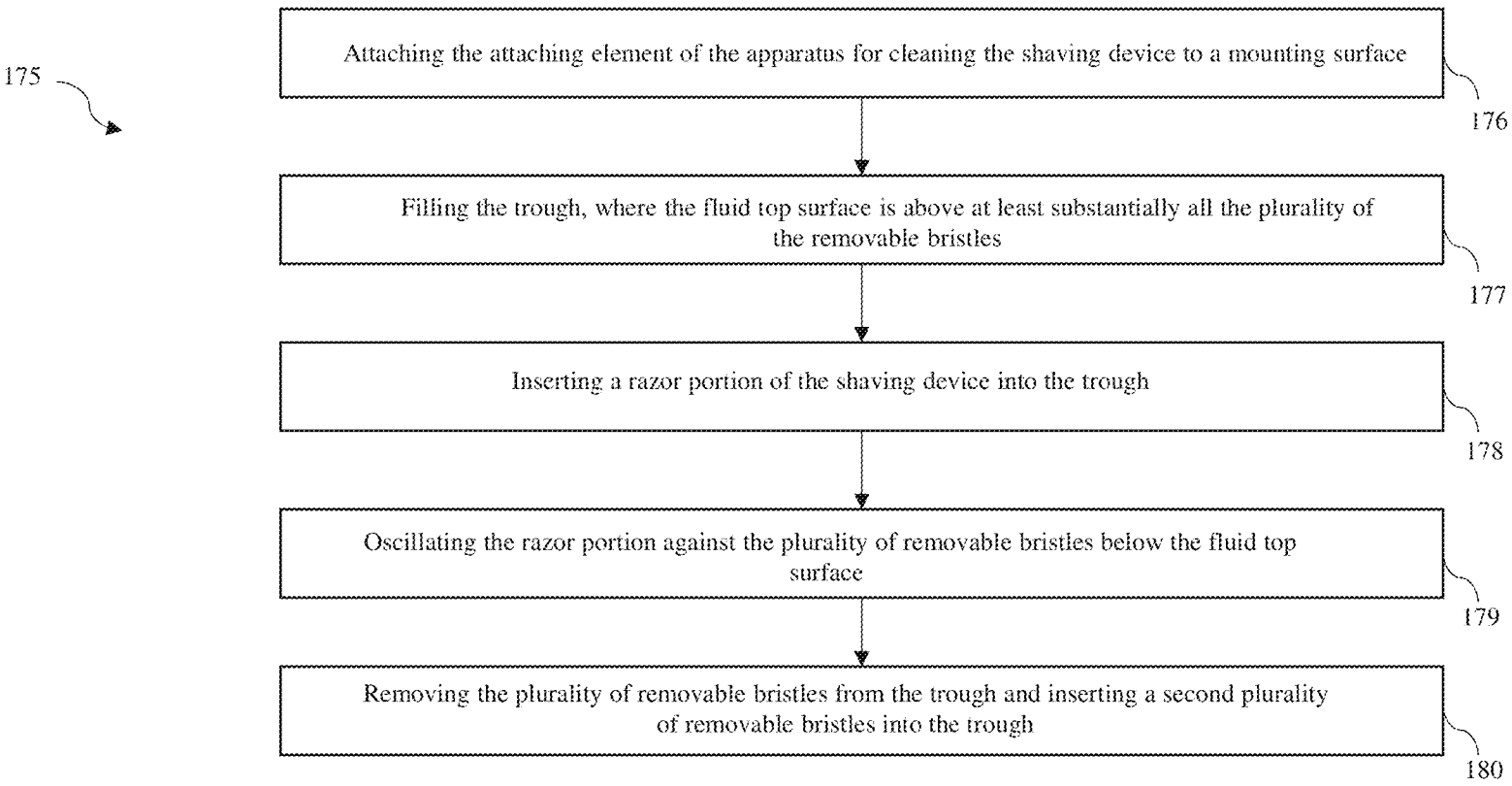
FIG. 9 is a method for cleaning a shaving device.

FIG. 9 is a method for cleaning a shaving device beginning with step 176. Step 176 tells the user to attach the attaching element of the apparatus to a mounting surface. The attaching element may require a mating surface to be installed on the mounting surface, for example if the attaching element is a magnet, the mounting surface will need to have a magnet as well. Once the apparatus is attached to a mounting surface the user will move to step 177. Step 177 directs the user to fill the trough with fluid in such a way that substantially all of the removable bristles are submerged in the fluid. The liquid may be water, antibacterial fluid, etc. Once the trough is filled with liquid, the user may move to step 178. Step 178 instructs the user to insert a razor portion of the shaving device into the trough through the elongated opening. Once the razor portion is inside the trough, the user can proceed to step 179. Step 179 directs the user to oscillate the razor portion against the removable bristles while submerged in the fluid. The fluid is necessary to remove the excess hair from the removable bristles. By moving the shaving device as described, the bristles will brush against the razor blades and leave the shaving device clean for the next use.

Furthermore, once the removable bristles have dulled, or are not efficient, the user can continue to step 180. Step 180 directs the user to remove the plurality of removable bristles from the trough and proceed to replace them by inserting a second plurality of removable bristles into the trough. This step is optional, however necessary to ensure the efficiency of the apparatus.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

I claim:

1. An apparatus for cleaning shaving devices, the apparatus comprising consisting of:

a base having:

a first dovetail mating surface on a top side of the base;

a substantially v-shaped opening on a slanted front wall of the base;

a cavity within the base contiguous to the v-shaped opening;

an elongated drain slot in the slanted front wall that is contiguous to the cavity of the base, the elongated drain slot disposed below the substantially v-shaped opening at a bottom portion of the slanted front wall;

an attaching element extending from the base;

a trough having:

a second dovetail mating surface on a bottom side of the trough removably coupled to the first dovetail mating surface of the base;

an angled front wall sloping downward and inward from a top portion of the trough to a bottom portion of the trough;

a shelf extending from the bottom portion of the trough and proximate to the bottom side of the trough;

a cover extending over a portion of a top opening of the trough, the cover defining an elongated insertion slot positioned above the angled front wall and sized to receive a razor head; and a removable pad within the trough proximate to the angled front wall, the removable pad having a plurality of bristles extending upward towards the top opening of the trough.

2. A system for cleaning shaving devices comprising:

a base having a first mating surface on a top side of the base; and a trough having:

a second mating surface on a bottom side of the trough removably coupled to the first mating surface of the base;

an angled front wall sloping downward and inward to an inner portion of the trough;

a shelf extending from the trough below the angled front wall; and a removable pad disposed within the trough, the removable pad having a plurality of bristles extending upward towards the top opening of the trough.

3. The system of claim 2 wherein the first mating surface and the second mating surface are interlocking dovetail joints.

4. The system of claim 2 wherein the base comprises a slanted front wall having a substantially v-shaped opening, a cavity within the base contiguous to the v-shaped opening, and an elongated drain slot in the slanted front wall that is contiguous to the cavity of the base, the elongated drain slot disposed below the substantially v-shaped opening at a bottom portion of the slanted front wall.

5. The system of claim 2 comprising a cover extending over a top portion of the trough, the cover defining an elongated insertion slot aligned positioned above the angled front wall and sized to receive a razor head.

6. An apparatus for cleaning shaving devices comprising:

a base having a first mating surface on a top side of the base; and an attaching element extending from the base;

a trough having:

a second mating surface on a bottom side of the trough removably coupled to the first mating surface of the base; and an angled front wall sloping downward and inward to an inner portion of the trough.

7. The apparatus of claim 6 comprising a removable pad disposed within the trough, the removable pad having a plurality of bristles extending upward towards the top opening of the trough.

8. The apparatus of claim 7 wherein the base comprises a slanted front wall having a substantially v-shaped opening, a cavity within the base contiguous to the v-shaped opening, and an elongated drain slot in the slanted front wall that is contiguous to the cavity of the base, the elongated drain slot disposed below the substantially v-shaped opening at a bottom portion of the slanted front wall.

9. The apparatus of claim 8 comprising a shelf extending from the trough below the angled front wall.

10. The system of claim 9 wherein the first mating surface and the second mating surface are interlocking dovetail joints.

11. The system of claim 10 comprising a cover extending over a top portion of the trough, the cover defining an elongated insertion slot aligned positioned above the angled front wall and sized to receive a razor head.

* * * * *